US005704153A

United States Patent [19]

Kaminski et al.

[11] Patent Number: 5,704,153

[45] Date of Patent: Jan. 6, 1998

[54] FIREARM BATTERY AND CONTROL MODULE

[75] Inventors: Kevin A. Kaminski, Plainville, Conn.; Douglas G. Overbury, Strathroy, Canada

[73] Assignee: Colt's Manufacturing Company, Inc., West Hartford, Conn.

[21] Appl. No.: 685,347

[22] Filed: Jul. 23, 1996

[51] Int. Cl.[6] ..... F41A 17/00

[52] U.S. Cl. ..... 42/70.11; 42/84; 42/103

[58] Field of Search ..... 42/70.11, 7, 66, 42/84, 103; 89/132, 135; 320/2, 11, 33, DIG. 1; 136/215, 253

[56] References Cited

U.S. PATENT DOCUMENTS

| | | | |
|---|---|---|---|
| 307,070 | 10/1884 | Russell | 42/84 |
| 3,631,623 | 1/1972 | Platt | 42/84 |
| 3,939,679 | 2/1976 | Barker et al. | 70/277 |
| 4,003,152 | 1/1977 | Barker et al. | 42/70 R |
| 4,467,545 | 8/1984 | Shaw, Jr. | 42/70 R |
| 4,488,370 | 12/1984 | Lemelson | 42/70 R |
| 4,563,827 | 1/1986 | Heltzel | 42/70 R |
| 4,682,435 | 7/1987 | Heltzel | 42/70.01 |
| 4,793,085 | 12/1988 | Surawski et al. | 42/84 |
| 4,934,086 | 6/1990 | House-Walter | 42/103 |
| 5,052,138 | 10/1991 | Crain | 42/1.02 |
| 5,062,232 | 11/1991 | Eppler | 42/70.11 |
| 5,083,392 | 1/1992 | Bookstaber | 42/84 |
| 5,119,576 | 6/1992 | Erning | 42/103 |
| 5,168,114 | 12/1992 | Enget | 42/70.01 |
| 5,177,309 | 1/1993 | Willoughby et al. | 42/103 |
| 5,179,235 | 1/1993 | Toole | 42/103 |
| 5,192,818 | 3/1993 | Martin | 42/70.01 |
| 5,272,828 | 12/1993 | Petrick et al. | 42/84 |
| 5,301,448 | 4/1994 | Petrick et al. | 42/70.01 |
| 5,421,264 | 6/1995 | Petric | 102/443 |
| 5,448,847 | 9/1995 | Teetzel | 42/70.11 |
| 5,461,812 | 10/1995 | Bennett | 42/70.11 |
| 5,557,872 | 9/1996 | Langner | 42/103 |

FOREIGN PATENT DOCUMENTS

| | | |
|---|---|---|
| 3446019 | 7/1986 | Germany . |
| 3810048 | 10/1989 | Germany . |

*Primary Examiner*—Charles T. Jordan
*Assistant Examiner*—Meena Chelliah
*Attorney, Agent, or Firm*—Perman & Green, LLP

[57] ABSTRACT

A module having a housing, a battery, control circuitry and electrical conductors. The battery and control circuitry are contained in the housing. The housing is adapted to be removably connected to the frame of a firearm. The electrical conductors are located on the housing and allow the battery and control circuit to be electrically connected to other components of the firearm. The housing can be connected at a hand grip section of the firearm and forms a substantial portion of at least one exterior side of the firearm at the hand grip section.

20 Claims, 4 Drawing Sheets

FIG. 3
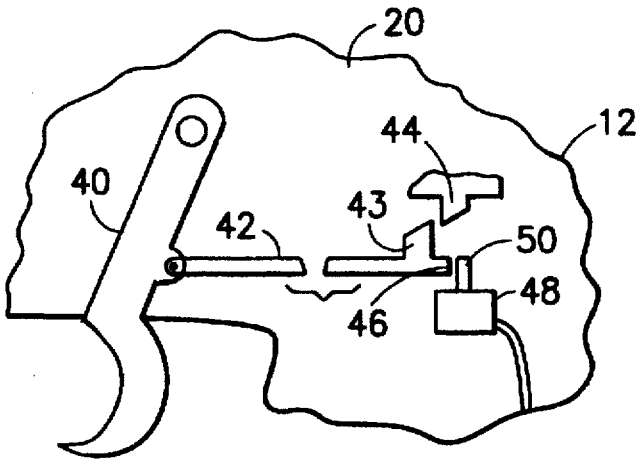
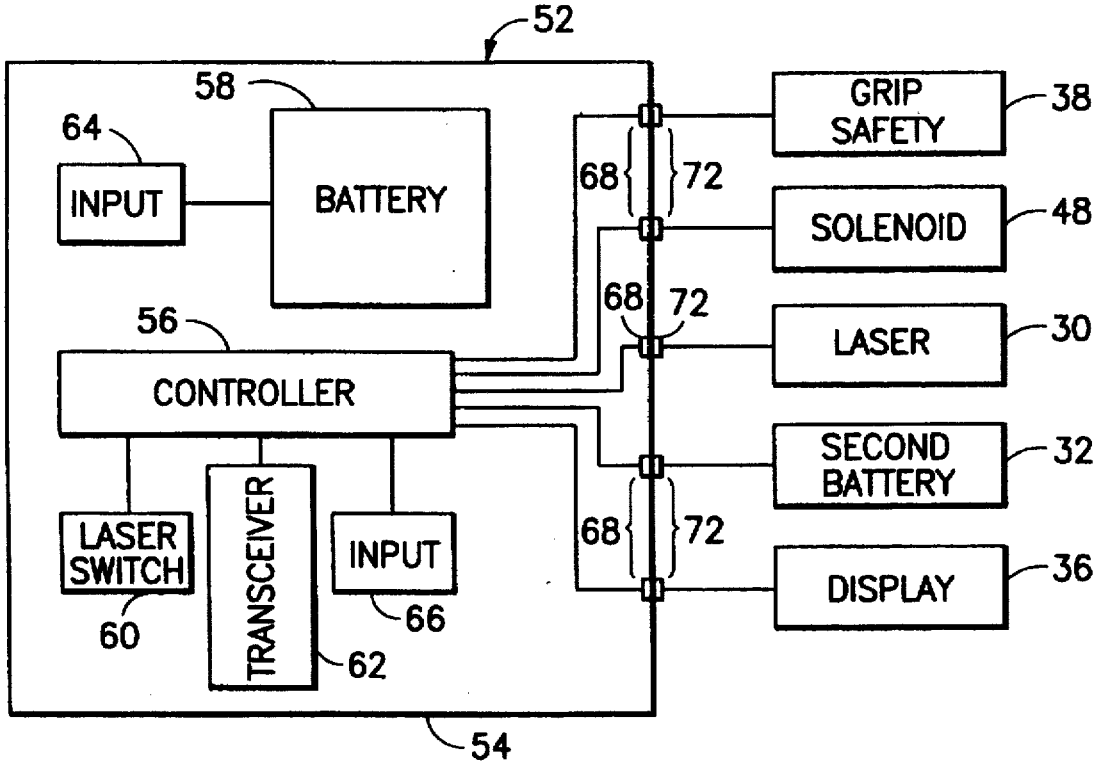
FIG. 4

FIREARM BATTERY AND CONTROL MODULE

BACKGROUND OF THE INVENTION

1. Field of the Invention

The present invention relates to firearms and, more particularly, to a module having a battery and control circuitry that is removably connected to the rest of the firearm.

2. Prior Art

U.S. Pat. No. 5,052,138 discloses a magazine module with a microprocessor and a grip module with electronic circuitry. The magazine module also houses batteries. U.S. Pat. No. 5,461,812 discloses a firearm with a transmitter and a receiver, a ring having a transponder worn by a user, and a safety solenoid to block movement of a trigger mechanism.

SUMMARY OF THE INVENTION

In accordance with one embodiment of the present invention, a firearm fire control module is provided comprising a housing, a battery, a control circuit, and electrical conductors. The housing is sized and shaped to be connected to a frame of a firearm separate from a magazine of the firearm and without intruding into a magazine receiving area of the firearm. The battery is located in the housing. The control circuit is located in the housing and is electrically connected to the battery. The electrical connectors are connected to the control circuit for connecting the control circuit to other components of the firearm when the housing is connected to the firearm.

In accordance with another embodiment of the present invention, a firearm is provided comprising a frame, a barrel connected to the frame, a firing mechanism connected to the frame, a battery, and a control circuit. The improvement comprises a fire control module removably connected to the frame. The module has a housing with the battery and the control circuit located therein. The module also comprises electrical contacts on the housing that connect the control circuit and the battery to other components of the firearm. The housing has an exterior surface that forms a substantial portion of one side of a hand grip section of the firearm.

In accordance with another embodiment of the present invention, a firearm system is provided comprising a firearm and a unit intended to be carried on a user. The firearm has a frame, a firing mechanism connected to the frame, a firing mechanism interrupter connected to the frame for preventing actuating of the firing mechanism, and a fire control module removably connected to the frame and electrically connected to the interrupter. The module comprises control circuitry with a radio frequency receiver section. The unit intended to be carried by the user has a radio frequency transmitter section for transmitting a signal to the receiver section in the firearm. The firing mechanism interrupter prevents the firing mechanism from being actuated unless the receiver section is within range of the transmitter section and receives a signal from the transmitter section.

In accordance with another embodiment of the present invention, a firearm system is provided comprising a frame, a barrel, a firing mechanism, and a fire control module. The frame has a hand grip section. The barrel is connected to the frame. The firing mechanism is connected to the frame. The fire control module is connected to the frame at the hand grip section. The module has a housing that forms a substantial portion of at least one exterior side of the firearm at the hand grip section.

BRIEF DESCRIPTION OF THE DRAWINGS

The foregoing aspects and other features of the invention are explained in the following description, taken in connection with the accompanying drawings, wherein:

FIG. 3 is a schematic view of a portion of the firing mechanism of the firearm shown in FIG. 1;

FIG. 4 is a schematic diagram of the control module of the firearm shown in FIG. 1 that is shown connected to other components of the firearm;

DETAILED DESCRIPTION OF THE PREFERRED EMBODIMENT

Figure 1:
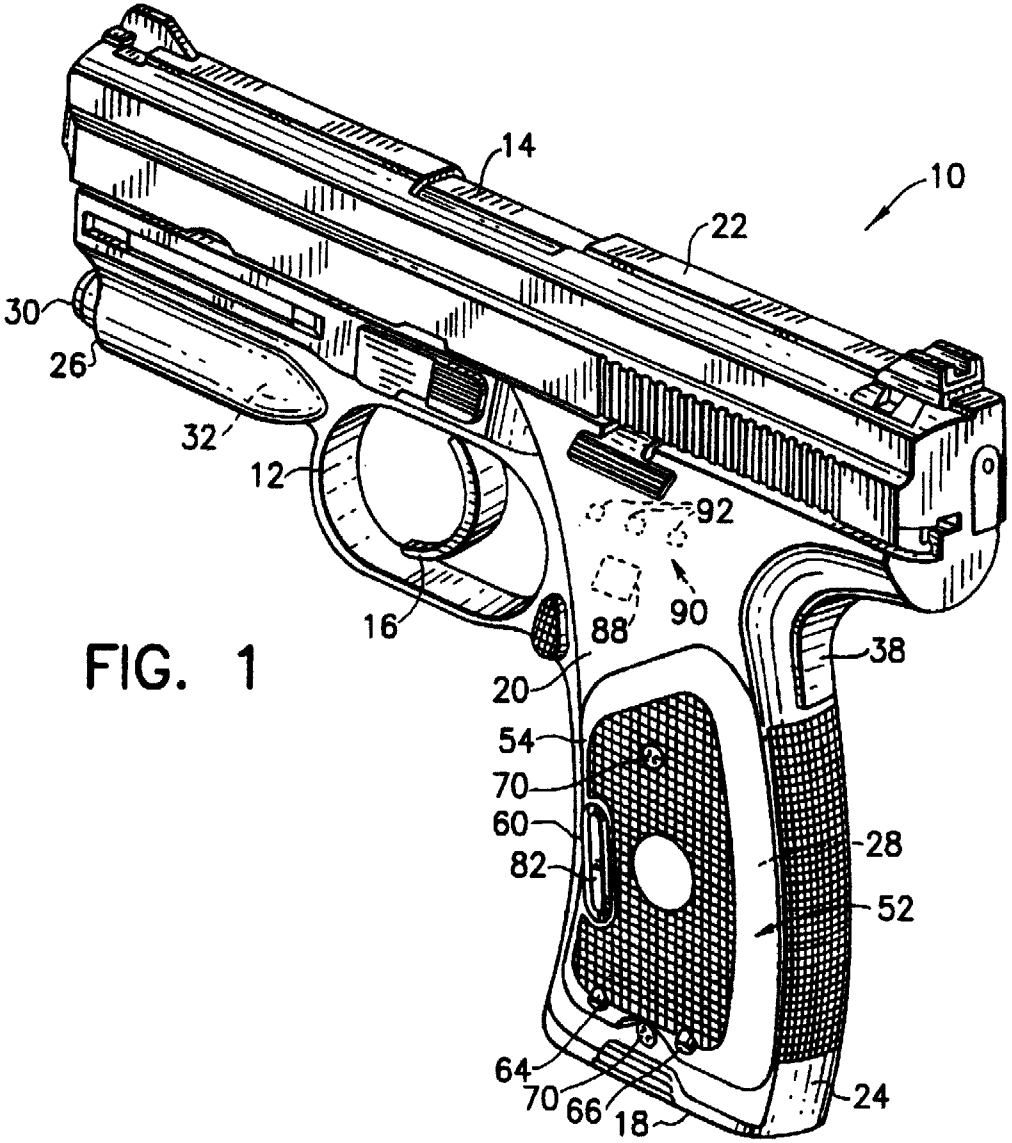
FIG. 1 is a perspective view of a firearm incorporating features of the present invention.

Referring to FIG. 1, there is shown a pistol 10 incorporating features of the present invention. Although the present invention will be described with reference to the single embodiment shown in the drawings, it should be understood that features of the present invention can be embodied in various different forms of alternative embodiments. In addition, any suitable size, shape or type of elements or materials could be used. Features of the present invention may also be incorporated into other various types of firearms. The pistol 10 is a semiautomatic pistol which comprises a frame 12, a barrel 14, a firing mechanism 16, and a removable cartridge magazine 18.

Figure 2:
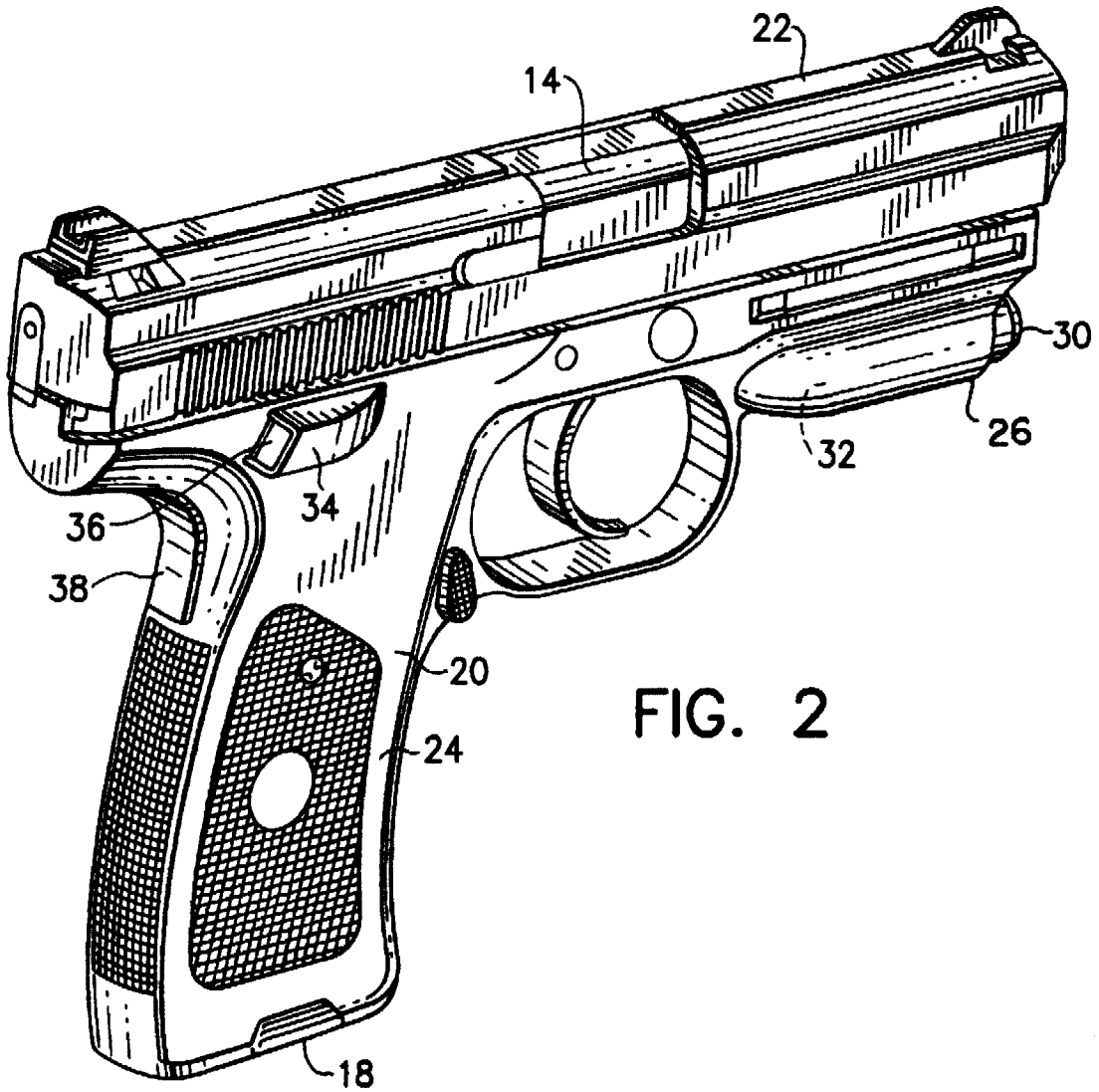
FIG. 2 is a perspective view of the firearm shown in FIG. 1 from an opposite side.

The frame 12 includes a main section 20 and a slide 22. The slide 22 is slidingly mounted on the main section 20. The main section 20 includes a hand grip section 24 and a front laser housing section 26. The hand grip section has a receiving area 28 for removably receiving the cartridge magazine 18. A laser sighting device 30 is mounted in the front laser housing section 26. A battery 32 for the laser sighting device 30 is also mounted in the housing section 26 behind the device 30. In an alternate embodiment the laser sighting device 30 and/or laser battery 32 need not be provided. The section 26 could then be used to house merely a second larger battery for use with the firing mechanism and/or safety system. Alternatively, the section 26 need not be provided. Referring also to FIG. 2, the right side of the main section 20 has a display housing section 34 with a rearward facing electronic display 36, such as an LCD. However, in an alternate embodiment, an electronic display need not be provided. The rear of the main section 20 includes a movable safety lever or grip safety 38 that is depressed when a user grasps the hand grip section 24. The grip safety 38 is preferably a combined mechanical safety to prevent the firing pin from reaching a battery position and, an electrical switch. However, the grip safety 38 could merely be a mechanical safety or an electrical switch. In an alternate embodiment the lever 38 need not be provided.

Referring also to FIG. 3, the firing mechanism 16 includes a user actuated trigger 40, a trigger bar 42, and sear 44. The trigger 40 is pivotably connected to the main section 20 of the frame 12. In an alternate embodiment the trigger could be slidingly mounted on the frame. The trigger bar 42 is pivotably connected to the trigger 40. The trigger bar 42 has a sear section 43 and a stop surface 46. The sear 44 is connected to a firing pin (not shown) in the slide 22. When the trigger 40 is pulled to rotate rearward by a user, the trigger bar 42 can move the sear 44 rearward by the sear surface 43 pushing against the sear 44. At an end of rearward travel, the sear surface 43 disengages from the sear 44 to allow the firing pin to propel forward to contact and discharge a cartridge.

The firearm 10 also has a safety system with an interrupter or blocker 48. The blocker 48, in the embodiment shown, is a solenoid device with a movable blocking section 50. When the solenoid is energized and de-energized, the blocking section 50 can be moved out of and into the path of the trigger bar 42 behind the stop surface 46. When the blocking section 50 is located in the path behind the stop surface 46, it prevents the trigger bar 42 from moving rearward. Therefore, the firing mechanism is prevented from operating. In a preferred embodiment, the blocking section 50 is located in the path of the trigger bar 42 when the solenoid is de-energized. However, in an alternate embodiment, the blocking section 50 could be located in the path of the trigger bar 42 only when the solenoid is energized. In other alternative embodiments, any suitable type of blocker could be provided, such as a micro-motor with a blocking section. Any suitable type of firing mechanism could also be provided. One alternate embodiment could include a pin which is moved in and out of a blocking position by an electric motor. Another alternate embodiment could include a gear motor moving a pin or a selector gear.

As seen best in FIG. 1, the firearm 10 includes a module 52 that is attached to the main section 20 of the frame 12 at the left side of hand grip section 24. In an alternate embodiment, the module 52 could be suitably sized and shaped to be attached to any suitable location on a frame. It is known in the art to attach hand grip panels to the lateral sides of the hand grip section of a frame of a pistol. However, such hand grip panels merely function to cover holes in the frame at the hand grip section, form a good hand grip surface, and serve a decorative purpose. The module 52 has a housing 54. The housing 54 has an exterior side that forms a substantial portion of the left exterior side of the firearm at the hand grip section 24. The module housing 54, in addition to other features, performs the same function as one of the old prior art hand grip panels. In an alternate embodiment a module could be alternatively or additionally attached to the right side of the hand grip section.

Referring also to FIG. 4, the module 52 includes the housing 54, a controller 56, a battery 58, a switch 60, a transceiver 62, a first input 64, a second input 66, and electrical contacts 68. The housing 54 is stationarily connected to the main section 20 of the frame 12. Preferably, the housing 54 is removably connected to the main section 20 by tamper resistant fasteners 70. The exterior of the housing 54, at the left side, is textured for better grip by the user. As seen in comparing FIG. 1 to FIG. 2, the right side of the hand grip section is substantially flat. The left side, however, projects slightly outwardly in order to accommodate the thickness of the components inside the housing 54. The housing 54 is received in a receiving seat of the frame 12. A rear side of the housing 54 is located adjacent the magazine receiving area 28 and forms a portion of a side wall of the receiving area 28. Thus, the module 52 is a separate component from the magazine 18 and does not intrude into the magazine receiving area of the firearm. Preferably, the magazine 18 is of a substantially conventional configuration consisting of merely a housing, a spring and a follower. The electrical contacts 68 are mounted on the housing 54 and make a removable electrical connection with electrical contacts 72 on the main section 20 of the frame. The contacts 72 are electrically connected to the other electrical and electronic components of the firearm; grip safety 38, solenoid 48, laser 30, second battery 32, and display 36. In an alternate embodiment, rather than the contacts 68 mounted on the housing 54, the module 52 could have wire conductors that extend to the various other electrical and electronic components.

Figure 5:
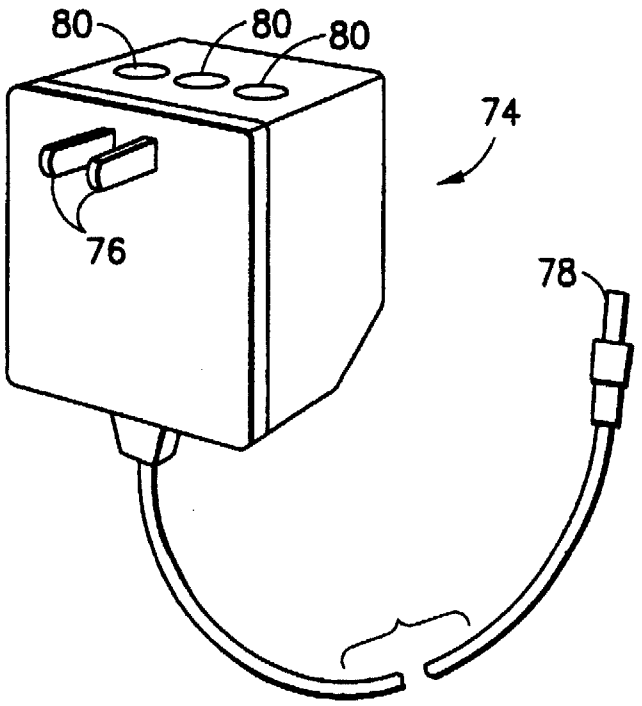
FIG. 5 is a perspective view of a battery recharger for use with the firearm shown in FIG. 1.

The controller 56 preferably comprises a printed circuit board with a micro-computer or microprocessor, and a power relay. The battery 58 is connected to the controller 56. The controller 56 controls whether or not energy from the battery 58 is used to energize the solenoid 48. Preferably, the battery 58 is a rechargeable battery. The first input 64 is a battery recharger terminal which is connected to the battery 58. A battery recharger 74 for use with the firearm 10 and module 52 is shown in FIG. 5. The recharger 74 is merely an AC transformer with electrical terminals 76 to be inserted into an electrical outlet, a plug 78 for insertion into the terminal 64, and indicator lights 80 for signalling status, such as power ON, charging, and fully charged. However, in alternate embodiments, any suitable type of battery charger could be provided.

Referring back to FIGS. 1 and 4, the switch 60 is a user actuated switch with an actuator 82 located on the exterior side of the housing 54. The actuator 82 can be depressed by a user's finger. The switch 60 is an electrical switch that is electrically connected to the laser 30 and second battery 32 by the controller 56. In an alternate embodiment the switch could be connected to the laser 30 and second battery 32 separate from the controller 56. When a user depresses the actuator 82 the switch 60 is closed to supply electricity from the second battery 32 to the laser 30. In an alternate embodiment the first battery 58 could supply electricity to the laser 30 or both batteries could supply electricity to the laser 30. Other types of actuators could also be provided. In the embodiment shown, the actuator 82 is located at the front of the module housing 54 and has a general bar shape for easy depression by a variety of user hand sizes.

Figure 6A:
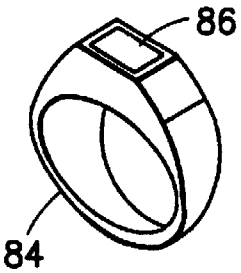
FIG. 6A is a perspective view of a ring of a firing system used with the firearm shown in FIG. 1.
Figure 6B:
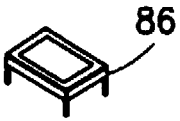
FIG. 6B is a perspective view of a transponder used in the ring shown in FIG. 6A.

The transceiver 62 is adapted to send and receive radio signals. In a preferred embodiment the transceiver 62 is only active when the safety grip 38 is depressed. The controller 56 supplies power to the transceiver 62 from the first battery 58. Referring also to FIG. 6A, a unit 84 is shown that forms a firearm system with the firearm 10. The unit 84 is a finger ring intended to be worn by a user. Referring also to FIG. 6B, the ring 84 has a radio frequency transponder 86. When the transmitter section of the transceiver 62 sends out a signal, the transponder 86 receives the signal and transmits a signal back to the receiver section of the transceiver 62. When this is accomplished the transceiver 62 sends a signal to the controller 56. The controller 56, in turn, moves the solenoid 48 to a non-blocking position such that the pistol 10 can be fired. In a preferred embodiment, once the controller 56 receives a signal from the transceiver 62, the controller 56 stops the supply of power to the transceiver 62 while the grip safety is still depressed. This serves to conserve power of the first battery 58. The controller 56 keeps the solenoid 48 in its non-blocking position until the grip safety 38 is released. The signal range of the transceiver 62 and transponder 86 are limited. Preferably, the transceiver 62 and transponder 86 have a maximum interactive signal range of about three feet. However, this signal range could be varied based upon power supplied to the transceiver and transponder to between about one inch to about five feet. Preferably, the transceiver and transponder operate in radio frequencies in the 900 MHz range. The signal range could also be configured based upon antenna length and/or shielding in the module 52. The signals transmitted between the transceiver 62 and the transponder 86 are preferably coded, such as with a pulse coding or a frequency coding. Only if the transceiver and transponder are within range of each other, and the proper signals are received by the transceiver, does the controller 56 move the blocker 48 out of its blocking position. The transponder 86 could have its own power supply in the unit 84 or merely use the power from the transceiver signal to supply the return signal to the transceiver. Rather than the transponder 86, the unit 84 carried or worn by the user could have a transceiver and additional circuitry. Preferably, the signal frequency and/or recognition code of each firearm/unit pair is unique such that only a designated firearm and unit can be used together. However, groups of firearm/unit pairs could be similarly programmed, such as for pairs of police officer partners.

In an alternate embodiment, the transceiver could be located in another item, such as a police badge. In another alternate embodiment, the transceiver could be carried in a location that the user could easily throw away from him, such as if the user is in a struggle with a criminal for the firearm. By throwing the transponder unit out of the range of the firearm, the firearm becomes unable to fire, thereby preventing the criminal from shooting the rightful user with his own firearm. In the alternate embodiment where the grip safety 38 is not electrically connected to the controller 56, the firearm 10 could have a switch 88, such as a magnetic read switch, that is activated when the firearm 10 is removed from a holster that has a magnet. The unit 84 could also comprise an emergency off switch that could be activated by the user. The firearm 10 can also comprise an emergency control 90 to mechanically place the blocker 48 in a non-blocking position. Preferably the emergency control 90 is a code control mechanism having push buttons 92. The push buttons have to be actuated in a predetermined sequence before the blocker 48 is manually moved to a non-blocking position. With this embodiment, even if the battery 58 fails or if the blocker 48 fails or if the transceiver 62, transponder 86 or any part of the module 52 fails, a user who knows the code for the control 90 can place the firearm into operation.

Figure 7:
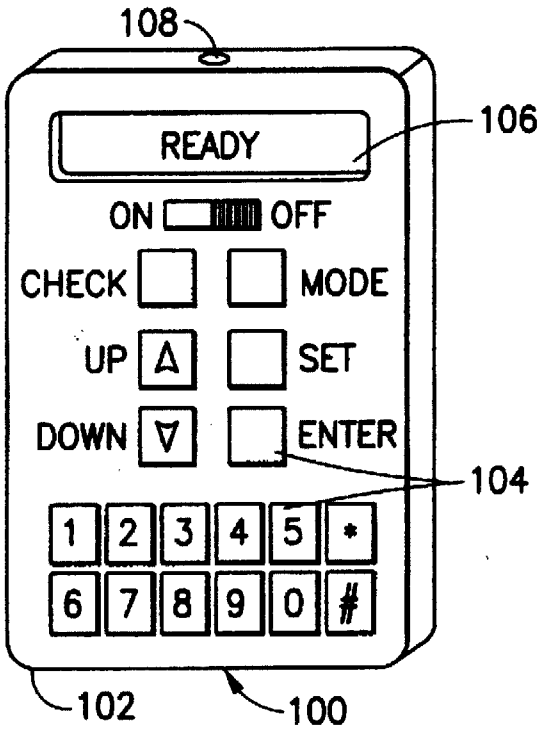
FIG. 7 is a perspective view of a programming unit for use with the firearm shown in FIG. 1.

Referring also to FIG. 7, a programming unit 100 for use with the firearm 10 is shown. The programming unit 100 has a housing 102, keys 104, a display 106, and an infrared transmitter 108. The second input 66 on the module 52 is an infrared receiver. The programming unit 100 can be used to program the controller 56 by infrared signals received by the input 66. The programming of the controller 56 could include any suitable coding instruction or operational instruction. In alternate embodiments, other types of programming units could be provided. The means for re-programming could also be other than infrared, such as a direct electrical connection by a conductor or radio signals. Alternatively, the module 52 need not be re-programmable and may be sealed to prevent re-programming. The module 52 can display program codes on the LCD display 36 and may also be provided with a signaler to give audible tones as programming is changed and/or to signal low battery power. If desired, the unit 100 could be used to turn the signaler ON and OFF. Removal of the module 52 from the frame 12 preferably makes operation of the firing mechanism impossible without removing the blocker and/or adding additional parts. Modules 52 could be provided on both the left and right sides of the hand grip section for added redundancy in both the power supply and the safety systems.

As noted above, the module 52 is preferably attached to the frame 12 by tamper resistant fasteners. The fasteners would be specially attached during manufacture and could require return to the factory for removal. Therefore, if the pistol 10 is stolen or wrongfully taken away from the user, it will take considerable time and effort to remove the module 52 to attempt to remove the safety system. However, this helps to prevent the pistol 10 from being immediately used against the rightful user.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm fire control module comprising:

a housing sized and shaped to be connected to a frame of a firearm separate from a magazine of the firearm and without intruding into a magazine receiving area of the firearm;

a rechargeable battery located in the housing;

a battery charging terminal on the housing;

a control circuit located in the housing and electrically connected to the battery; and electrical conductors connected to the control circuit for connecting the control circuit to other components of the firearm when the housing is connected to the firearm.

2. A module as in claim 1 wherein the housing is sized and shaped to be removably connected to a frame of the firearm.

3. A module as in claim 2 wherein the housing is sized and shaped to be connected to a hand grip section of the frame and form a substantial portion of at least one exterior lateral side of the firearm at the hand grip section.

4. A module as in claim 2 wherein the electrical conductors comprise first electrical contacts for making a removable electrical connection with second electrical contacts on the frame of the firearm.

5. A module as in claim 1 further comprising a user actuated switch connected on the housing and having an actuator at an exterior side of the housing.

6. A module as in claim 1 further comprising an infrared receiver on the housing.

7. In a firearm having a frame, a barrel connected to the frame, a firing mechanism connected to the frame, a battery, and a control circuit, wherein the improvement comprises:

a fire control module removably connected to the frame, the module having a housing with the battery and the control circuit located therein and electrical contacts on the housing that connect the control circuit and the battery to other components of the firearm, the housing having an exterior surface that forms a substantial portion of one side of a hand grip section of the firearm, and the module further comprising a battery recharging connector connected to the housing.

8. A firearm as in claim 7 wherein the other components of the firearm include a laser connected to the frame.

9. A firearm as in claim 8 wherein the module includes a user actuated switch connected to the housing and having an actuator on an exterior side of the housing.

10. A firearm as in claim 7 wherein the other components of the firearm include an electronic display connected to the frame.

11. A firearm as in claim 7 wherein the one side of the hand grip section of the firearm is a lateral side.

12. A firearm as in claim 7 wherein the module further comprises an infrared receiver on the housing.

13. A firearm as in claim 12 wherein the control circuit includes a radio frequency transceiver.

14. A firearm as in claim 7 further comprising a safety system with a firing mechanism blocker and a transceiver in the control circuit, wherein the blocker prevents the firing mechanism from operating unless the transceiver receives a signal from a transponder carried on an intended user of the firearm.

15. A firearm as in claim 7 further comprising a second battery connected to the frame separate from the fire control module and which is electrically connected to the fire control module.

16. A firearm system comprising:

a firearm having a frame, a firing mechanism connected to the frame, a firing mechanism interrupter connected to the frame for preventing actuation of the firing mechanism, and a fire control module removably connected to the frame and electrically connected to the interrupter, the module comprising control circuitry with a radio frequency receiver section, a battery connected to the control circuitry and a battery recharging connector connected to the battery;

a battery recharger connectable to the battery recharging connector of the module; and a unit intended to be carried on a user, the unit having a radio frequency transmitter section for transmitting a signal to the receiver section in the firearm, wherein the firing mechanism interrupter prevents the firing mechanism from being actuated unless the receiver section is within range of the transmitter section and receives a signal from the transmitter section.

17. A system as in claim 16 wherein the unit comprises a radio frequency transponder and the control circuitry comprises a radio frequency transceiver.

18. A firearm system comprising:

a frame having a hand grip section;

a barrel connected to the frame;

a firing mechanism connected to the frame; and a fire control module connected to the frame at the hand grip section, the module having a housing that forms a substantial portion of at least one exterior side of the firearm at the hand grip section and a rechargeable battery located inside the housing, wherein a battery recharging connector is provided that is electrically connected to the battery for recharging the battery.

19. A system as in claim 18 further comprising a second battery connected to the frame separate from the fire control module.

20. A system as in claim 19 wherein the fire control module is electrically connected to the second battery.

* * * * *